United States Patent [19]

Imler

[11] 4,114,208

[45] Sep. 19, 1978

[54] WATER CLOSET FLUSH VALVE

[76] Inventor: Carl E. Imler, 213 W. Kirwin, Salina, Kans. 67401

[21] Appl. No.: 802,432

[22] Filed: Jun. 1, 1977

[51] Int. Cl.[2] ..... E03D 1/36; E03D 1/06

[52] U.S. Cl. ..... 4/366; 4/370; 4/374; 137/410

[58] Field of Search ..... 4/18.5, 41, 42, 44–47, 4/67 R, 67 A, 57 R, 57 P, 366, 367, 370, 374, 376, 377; 137/410, 411, 434, 446

[56] References Cited

U.S. PATENT DOCUMENTS

| | | | |
|---|---|---|---|
| 1,081,110 | 12/1913 | Gondolf | 137/410 X |
| 1,733,633 | 10/1929 | Sterbenz et al. | 4/41 |
| 2,068,252 | 1/1937 | Weber | 137/410 X |
| 2,093,584 | 9/1937 | Walker | 4/44 X |
| 2,177,121 | 10/1939 | Scott | 137/410 |
| 2,700,163 | 1/1955 | Sturman | 137/446 X |
| 2,837,111 | 6/1958 | Mueller | 137/410 |
| 3,424,187 | 1/1969 | Brennan et al. | 137/410 X |

*Primary Examiner*—Stuart S. Levy
*Attorney, Agent, or Firm*—Victor J. Evans & Co.

[57] ABSTRACT

Disclosed herein is a ballcock type flush valve that has all moving parts above the water line of the tank, thereby eliminating corrosion. The valve configuration is such that it is designed to shut-off the flow of water, thereby providing a positive shut-off, and further it is unique in that it has no seat or seal to leak that is below the water line. Fail safe features include a flush mechanism that will remain inoperative until the tank has regenerated its water supply, thereby providing a full flush. Anti-syphon means are included in addition to prevent back flow of bowl water into the water system. The ballcock flush valve combination is so constructed that ingress of additional water due to a faulty seal is impossible thereby conserving water.

7 Claims, 5 Drawing Figures

WATER CLOSET FLUSH VALVE

BACKGROUND OF THE INVENTION

1. FIELD OF THE INVENTION

The following invention relates generally to ballcock type flush valves. That is a device consisting of a valve connected by a lever with a floating ball which shuts the valve when raised and opens it when lowered, as in flush toilets. Conventional prior art devices have a plurality of moving parts which operate under the surface of the water, thereby suffering from additional wear due to the effect of the water on these components. In addition it will be appreciated that such systems sometimes suffer from a leaky valve in which water leaks out of the holding tank. When this occurs of course the float level will go down and additional water will be provided to close the valve on the ballcock and therefore the ballcock seat suffers from needless excessive wear, and this also constitutes a waste of water.

2. SUMMARY OF THE INVENTION

Accordingly it is seen to be desirable to develop a flush valve which is designed to shut-off with the flow of water, thereby providing a positive shut-off and minimizing wasted water due to leakage and excessive wear on the ballcock seat by compensation for this leakage. In addition the present invention provides a flush valve assembly which has fewer moving parts than that which is currently embodied in the state of the art. In fact a conventional mechanism for toilet flushing namely the flush ball wires and associated guide have been eliminated. The following invention is seen to be additionally efficient in that flushing the toilet is not possible until the tank has been refilled due to the unique cam action provided in the instant invention. Antisyphon means are included which prevents back flow into the water system.

OBJECT OF THE INVENTION

Accordingly it is an object of this invention to provide a ballcock flush valve combination which has fewer moving parts than conventional ones now in use.

It is a further object of this invention to provide a valve combination designed to shut-off the flow of water. It is a further object of this invention to provide a valve combination that has all moving parts above the water line of the tank, thereby eliminating corrosion. It is a further provision of this invention to provide a valve combination that has no seat or seal to leak that is below the water line.

A further object of this invention is to provide a valve combination that will not be operative until the holding tank for the water is full.

The valve combination further contemplates as its invention that there is anti-syphon means to prevent back flow into the water system.

It is yet an additional provision of this application to provide a valve combination that conserves water.

Other objects and advantages will become apparent in the following specification when considered in light of the attached drawings.

DESCRIPTION OF THE PREFERRED EMBODIMENT

Turning to the drawings now, in which like numerals refer to similar parts throughout the various drawings the general valve combination assembly can generally be denoted by numeral 40.

Figure 1:
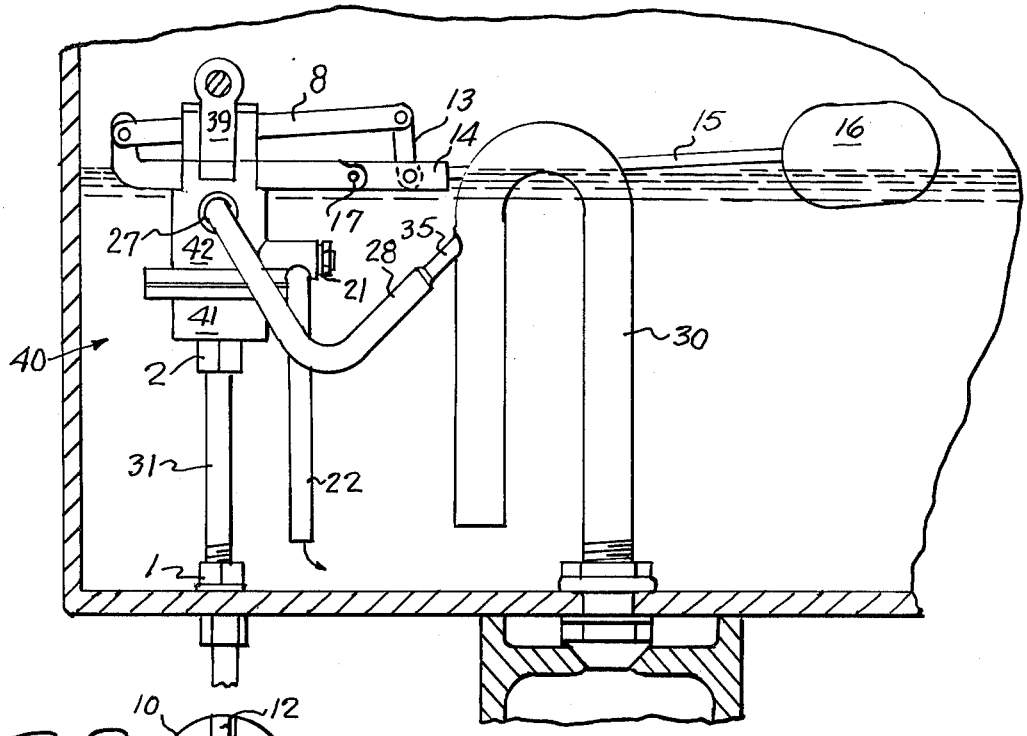
FIG. 1 is a depiction of the system according to the present invention in which the water tank has been cut away.

FIG. 1 best depicts the details for the ingress of water into the flush system. Numeral 1 generally denotes the water inlet tank fitting, and it is through this passageway that the water is delivered to the valve assembly through inlet tube 31 onward to valve inlet 2 of the valve assembly.

Figure 2:
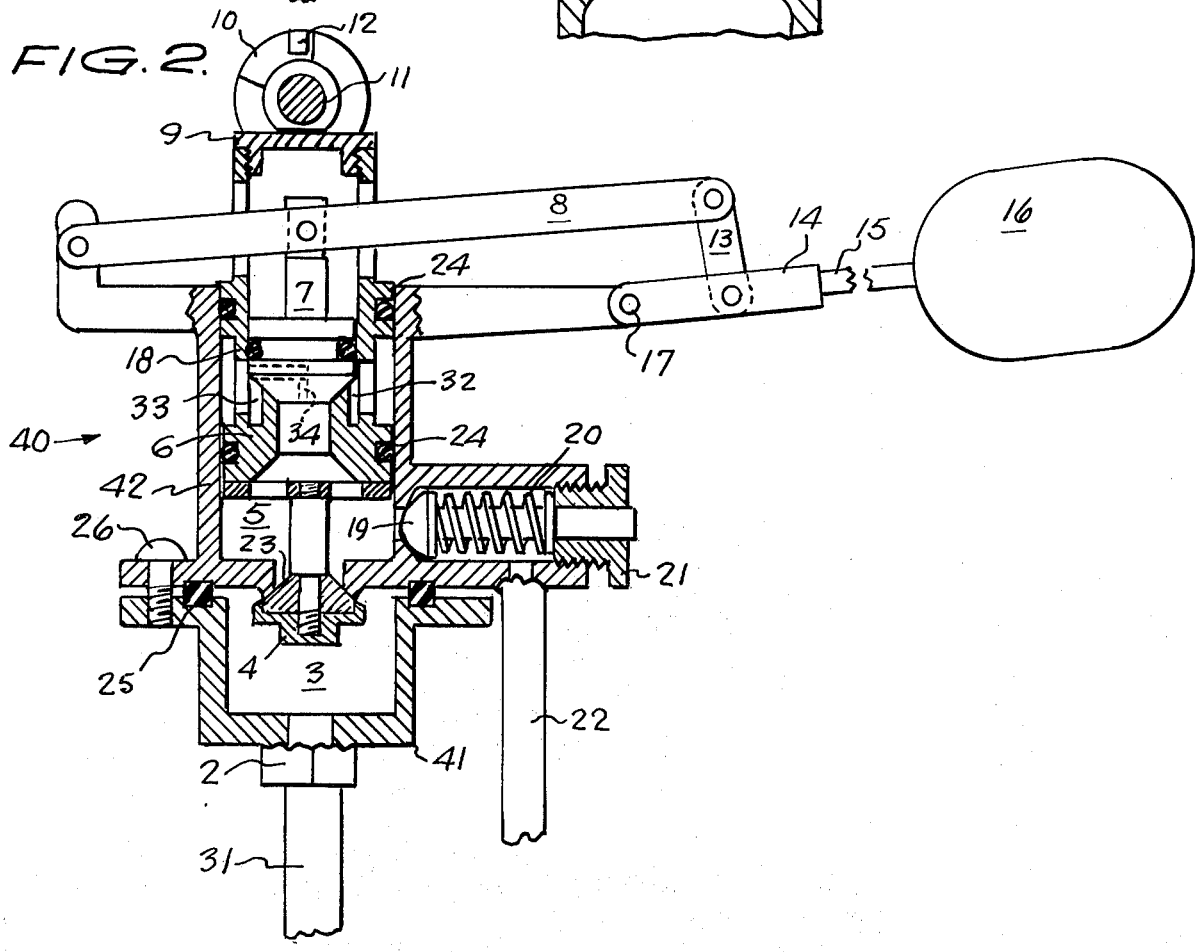
FIG. 2 is a sectional view of the flush combination shown in FIG. 1 taken in section.

The sectional view in FIG. 2 depicts a lower chamber in the valve assembly 3 which defines a lower valve body, and directly above the body portion there is disposed a washer cup 4 which underlies a beveled rubber washer 23. Bevel washer 23 provides first sealing means for maintaining the system in its initialized state as depicted in FIG. 2 i.e. that is when the tank is full and the toilet has not been flushed. The lower casing 41 which defines the lower valve body 3 is maintained in a sealed relationship by means of gasket 25 which circumferentially surrounds the flange which extends outwardly from the lower body. The gasket is maintained in a state of compression by screw means 26.

Figure 3:
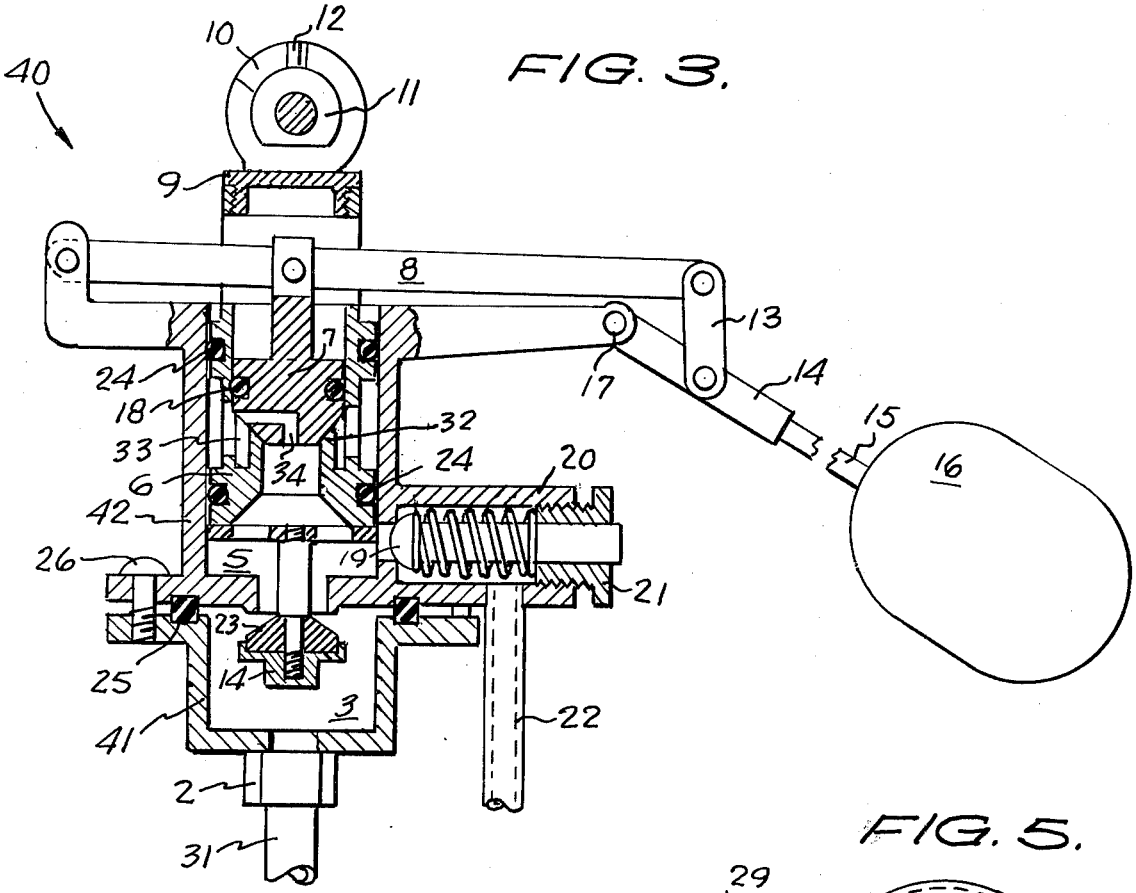
FIG. 3 is a similar view to that of FIG. 2 except that the valves in FIG. 3 are open, whereas in FIG. 2 the valves are shut.

Numeral 42 denotes the upper body portion of the valve assembly in which the upper valve chamber directly above beveled rubber washer 23 is allowed to communicate with the inlet water only upon actuation of the flush lever 39 shown in FIG. 1. Actuation of this lever causes cam shaft 11 which is attached to lever 39 to rotate, and as seen in FIGS. 2 and 3 the rotation of the cam 11 provides negative vertical displacement of valve piston 6, the action of this cam upon valve piston 6 is taken through piston cap 9.

At this moment float member 16 of FIG. 2 is still in the position depicted therein since no water has left the holding tank, and its action through float rod 15, float arm 14, connecting link 13, and stem operating lever 8 is at this moment negligible. Stem operating lever 8 is fastened to internal valve stem 7 which until this time has not exhibited any vertical displacement. However as the water level diminishes in the holding tank and float responsive ball means 16 descends on the diminishing liquid supply internal valve stems 7 will be displaced in a negative vertical direction. Before this can happen however there is provided a gap between piston 6 and valve stem 7 because of the negative vertical displacement of the piston 6 by virtue of its interaction with the cam 11. The bottom portion of internal valve stem 7 is provided with a valve seat 32 which is no longer in registry with piston 6, and this provides an opening for water to be deployed between the valve seat 32 and the piston through hole 33 as will be shortly apparent.

Figure 4:
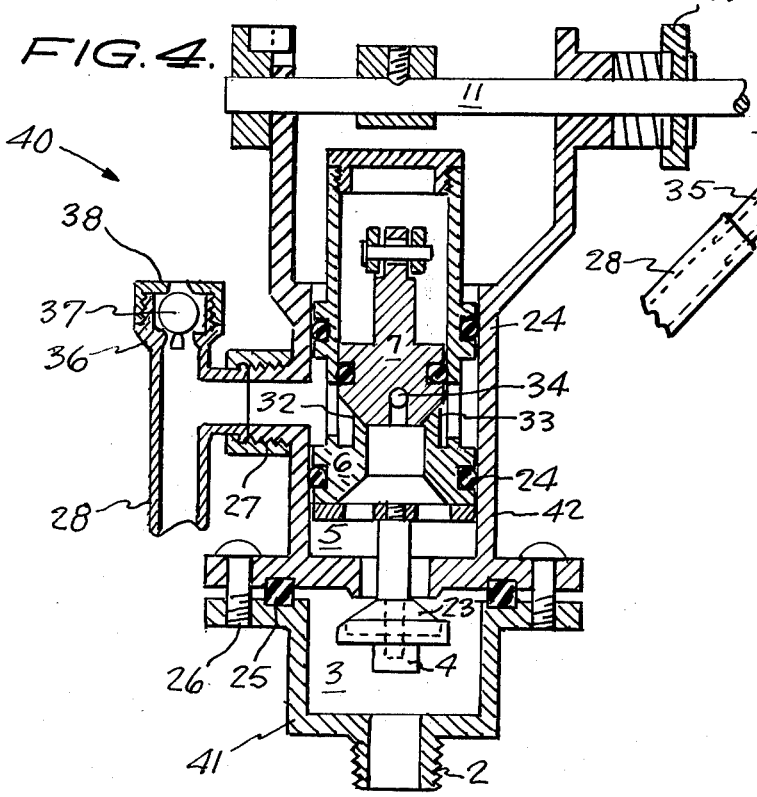
FIG. 4 shows another sectional view of the apparatus of FIG. 1 taken orthogonally to the views seen in FIGS. 2 and 3.
Figure 5:
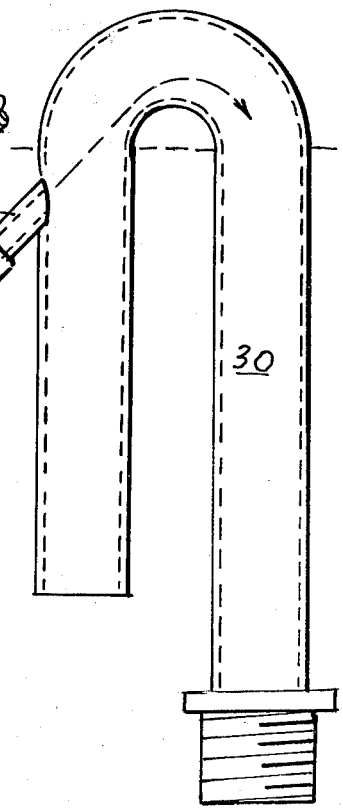
FIG. 5 is a detailed view of the syphon injector shown in FIG. 1.

The vertical displacement of valve piston 6 has additionally created a negative displacement of beveled rubber washer 23 by virtue of its link association with it through shaft and an annular flange which has orifices providing communication with water. This passageway defined by numeral 5 begins to fill water and its direction courses vertically upward between the piston and the internal valve stem through valve seat 32 and thereafter into hole 33. Hole 33 is a part of a series of orifice chambers which provide access with syphon supply opening 27, best seen in FIG. 4. Water emerging through opening 27 travels through syphon supply tube to 28 and then forward to syphon orifice 35 which is located within syphon 30 in a manner similar to an injector. FIG. 1 best depicts the interaction of the syphon orifice upon the syphon tube 30 and it is this action which creates an evacuation of the holding tank. However just prior to this evacuation of the water in the holding tank, the action of water running through syphon supply opening 27 and down syphon supply tube 28 creates an upward fluid pressure on float ball 37 disposed in tube 28 to raise it against its seat 38. It remains in this position as long as water is coming through beveled rubber washer 23 and past valve seat 32.

As the tank empties, float ball 16 will drop down, and following its travel are float rod 15, float arm 14, connecting link 13, stem operating lever 8, and internal valve stem 7. The effect of this negative vertical displacement of valve stem 7 is to reseat on internal valve seat 32 thereby closing off the water flow through hole 33 and therefore the syphon supply opening 27. This of course stops the induced syphon action and syphon tube 30 continues to evacuate the water in the holding tank. The additional pressure exerted through float 16 upon internal valve stem 7 causes further vertical displacement of the valve piston since they are in tangential relationship at internal valve seat 32, and this additional negative vertical displacement of valve piston 6 allows the cam 11 to return to its initial position.

Since water flow has been stopped through internal valve seat 32, the water pressure from inlet pipe 1 which passes by beveled rubber washer 23 creates fluid pressure in chamber 5 which causes plunger 19 to open as a pressure release and therefore to let water into the tank through tank fill tube 22. The pressure release characteristics of plunger 19 can be modified by reorienting adjusting nut 21 in its sleeve. This of course affects the spring tension of spring 20.

With water now entering the tank, and the syphon having been broken in tube 30 the float 16 will raise and in doing so it will lift internal valve stem 7 in a positive vertical direction and the fluid pressure in chamber 5 acting on piston 6 will cause the piston to rise concurrently, since the pressure of piston cap 9 has been removed by the secondary negative vertical displacement of valve piston 6 which was caused by internal valve stem 7 and the pressure exerted on it by float 16 on its downward motion. Valve piston 6 will continue in its upward motion until beveled rubber washer 23 is reseated and chamber 5 is closed from further water ingress. This effectively shuts off the flow of water into the tank and occurs concurrently with the tank having reached its proper fluid level.

However while the float ball 16 is rising, and internal valve stem 7 and valve piston 6 are in an upward motion, a small amount of water is admitted to syphon supply opening 27 through valve stem bypass 34. This travel of course will continue in through syphon supply tube 28 and thereafter through syphon orifice 35 to feed syphon 30 with water to refill the bowl and the tube. It is evident, though that when beveled rubber washer 23 returns to its seat the flow of water through internal valve stem bypass 34 and also through plunger 19 has been stopped, and this is when the tank has reached its proper level.

When the flow of water through supply opening 27 has stopped, float ball 37 will drop to float ball stop 36, thereby opening the hole in float seat 38 to admit air to chamber 5 through internal valve stem bypass 34.

The purpose of this opening bleed hole in the float seat 38 is to safe guard against syphoning of the tank water back into the water system. This could occur, for example, if there were no water in line 1 and therefore none in chamber 3. Beveled rubber washer 23 would be in its lowered position, as would valve piston 6 since it is supported indirectly on washer 23 by means of a shaft end annular disk which has orifices therein. The air from float seat 38 would therefore enter into lower valve body 3, thereby breaking any syphoning action that may occur which would tend to draw water back down the inlet pipe.

Accordingly it has been shown that the objects as set forth earlier have been accomplished by the valve combination as delineated above. The flush valve uses the pressure of the water on the inlet side to provide the sealing means regarded as rubber washer 23. In addition all of the moving components, for example all of the levers are above the water line, and do not suffer from corrosion due to exposure to water.

In a traditional system where a ballcock and conventional flush valve are used, a leaky flush valve will lower the water requiring additions of water to the tank and it will be appreciated that this results in unnecessary wear on the valve seat of the ballcock.

The major moving parts of the mechanism remain removed from the water by virtue of elements 8, 13, 14, 17, 9 and 11 being above the water line at all times. Further elements inside casing 42 are protected by piston O rings 24 and by stem O ring 18.

Having thus described the preferred embodiment of the invention it should be understood that numerous structural modifications and adaptations may be resorted to without departing from the spirit of the invention.

What is claimed is:

1. A ballcock flush valve comprising a water inlet connected to a lower housing provided with an outlet, and sealing means to close said outlet, an upper body portion communicating with said outlet having a piston means slidably disposed therein which rests on said sealing means, means on said piston disposed at an extremity remote from said sealing means to provide downward displacement of said piston and therefore said sealing means, valve stem means sequentially disposed on said piston means and displaceable in the same sense as said piston means, means connected to said valve stem means remote from said piston means to provide displacement of said valve stem means relative to said piston means, passage means disposed between said piston means and said valve stem means to provide a fluid passage when said piston means or said valve stem means moves relative to each other, syphon tube means communicating with said fluid passage to carry away the fluid which passes therethrough, and plunger means communicating with said upper body portion through a channel which serves to fill a tank reservoir when said sealing means is displaced allowing incoming water to enter into said upper portion.

2. The device set forth in claim 1 in which said means to seal the outlet of said lower housing comprises a washer disposed on a complementally formed cup which is connected through said opening by shaft means, said shaft means terminating in a perforated support for said piston means.

3. The device of claim 1 in which said means on said piston disposed at an extremity remote from said sealing means comprises a piston cap, a cam riding on said piston cap, a handle connected to said cam to allow rotation of said cam thereby displacing said piston cap and said piston means.

4. The apparatus of claim 1 in which said means connected to said valve stem means comprises linkage means connected to a float, said linkage means being disposed in a plane higher than said float means to assure that said linkage means remains above the water.

5. The apparatus as set forth in claim 1 in which said syphon tube means comprises a syphon supply tube communicating with said fluid passage, said syphon tube terminating in a syphon orifice which is disposed within an inverted U-shaped syphon in which one leg of said U-shaped syphon is disposed in an open fashion at the bottom of the water tank, and the other leg of said syphon communicates with a toilet whereby fluid emitted from said syphon orifice will create a syphon affect on said inverted U-shaped syphon to evacuate the water tank.

6. The apparatus as set forth in claim 5 in which said syphon means further includes a float ball disposed in said syphon tube having a float ball stop constraining said float ball from traveling in said tube and a float ball seat and cap disposed above said float ball to provide an air bleed when said syphon tube is empty and said float ball is in its rest position.

7. The apparatus as set forth in claim 6 in which said syphon means further includes an internal valve stem bypass disposed within said valve stem and communicating with said syphon tube to provide an avenue for air from said float ball to said upper body portion and thereafter said lower housing.

* * * * *